United States Patent [19]

Salloum

[11] Patent Number: 4,930,166

[45] Date of Patent: Jun. 5, 1990

[54] TOILET LID SAFETY RESTRAINT

[76] Inventor: Jan Salloum, 830 E. Beach Blvd., Long Beach, Miss. 39466

[21] Appl. No.: 355,926

[22] Filed: May 23, 1989

[51] Int. Cl.[5] ..... A47K 13/00

[52] U.S. Cl. ..... 4/253; 4/661; 24/17 R; 24/17 B

[58] Field of Search ..... 4/253, 661; 24/17 R, 24/17 B; 292/264

[56] References Cited

U.S. PATENT DOCUMENTS

| | | | |
|---|---|---|---|
| 735,927 | 8/1903 | Woodruff | 4/253 |
| 1,793,815 | 2/1931 | McConn | 4/253 |
| 1,826,010 | 10/1931 | McConn | 4/253 |
| 2,404,124 | 7/1946 | Des Roches | 4/234 |
| 2,558,578 | 6/1951 | Palmieri | 4/253 |

*Primary Examiner*—Henry V. Artis

*Attorney, Agent, or Firm*—Alexander F. Norcross

[57] ABSTRACT

A flexible securing harness, secures a toilet seat lid against raising by infants and children while permitting ready access by adults. The harness, composed of flexible strapping encircles the toilet bowl in a front girth strap and a rear girth strap, secured together by their bottom portions. The rear girth strap either continuously encloses a rear portion of the toilet bowl behind the seat or hooks to the toilet bowl lid hinge point. Two angled bridle assemblies extend from spaced upper points, one from each girth strap. The bridle assemblies are interconnected by an easily removable snap fitting to form a cross-hitch securing the toilet lid. The device is flexible, easily cleaned, and readily released and refastened for toilet use.

8 Claims, 1 Drawing Sheet

TOILET LID SAFETY RESTRAINT

BACKGROUND OF THE INVENTION

This invention addresses the problem of retaining a toilet seat temporarily closed against access. Two classes of such devices exist. One addresses the problem of securing a toilet seat closed in an unused or vacant building against trespassers and casual users. These type of closures emphasize security and resistance to tampering, at the expense of ease of use.

The second class of such devices, and the subject of the invention here disclosed, is for securing of a toilet lid against access by an inquisitive toddler or child as a safety measure. Such devices do not require extreme strength against physical tampering but must be relatively resistant to repeated extended manipulation, must not provide a means of injury to a careless or unknowing user, and must emphasize ease of use by authorized persons.

U.S. Pat. No. 735,927 to Woodruff discloses an early form of lock for toilet seat primarily for use in vacant buildings in which a chain, looped around the bowl, secures a metal clamping bracket which is chained under but which clamps around the top of the lid of the toilet bowl.

U.S. Pat. No. 2,558,578 was the closest known to the inventor showing flexible strapping. This patent discloses a harness, with buckles and belt holes of relatively standard construction. It can be belted around the base of the toilet bowl and snapped around a hinge member. The utility of this particular design is dependent upon there being an exposed hinge rod (FIG. 2, Item 6) which was typical in older toilet bowls but which is absent in the current design toilet bowls which use separated or concealed hinges.

U.S. Pat. No. 3,048,854 to Miller discusses the necessity of having a quick release on the cover and describes a cover specifically stated to prevent access to the toilet bowl by children. The securing device, however, is a physical clamp in the rim of the toilet bowl.

U.S. Pat. No. 3,477,070 discloses a device in which an adhesively affixed strap having holes is snapped over an adhesively affixed button having a protruding pin.

U.S. Pat. No. 4,763,363 to Lallemand discloses a toilet bowl lid securing apparatus which uses a preferably elastic strap with two clips, one clip being designed to be more or less permanently affixed to the inner wall of the toilet bowl and the second clip designed to clamp on the rear of the toilet bowl lid. The device leaves a vertical protuberance arising from the front of the toilet bowl.

SUMMARY OF THE INVENTION

This invention is an apparatus for securing a toilet lid in an easily opened, but normally closed position against tampering or entry by a small child or toddler.

The problem of babies falling into toilets or playing with the water in toilets is a serious hazard.

Several commercial items are currently being sold to permit a parent to lock down a toilet seat while not in use; these are typically some form of strap and latch, affixed to the side of the toilet bowl and the top of the seat by means of a contact glue. The latch mechanism is designed to be "baby proof". There is an active market for such devices and representative latches are being marketed by Playskool, as well as by major Japanese toy firms.

This invention is for a strap-on flexible harness. The harness can be removably affixed, or clipped to the toilet bowl. It adapts to both standard form and more modern, elongate toilet bowls. The device is basically a two loop or section harness, which is joined by a simple snap clip. The clip is readily unsnapped, pulling the front loop off the toilet bowl for use. The loop is then pulled over the toilet bowl to hold it closed and the clip snapped again when use is finished.

The device is more easily installed than the current adhesively affixed latches, and is less likely to fail in practice. Adhesive latches have a tendency to be pulled off the toilet bowls because condensation moisture makes the adhesive bonding less than adequate. Some of the latches are difficult to manipulate and result in the frustrated user tearing them free from the bowl.

DETAILED DESCRIPTION OF THE PREFERRED EMBODIMENT

Figure 2A:
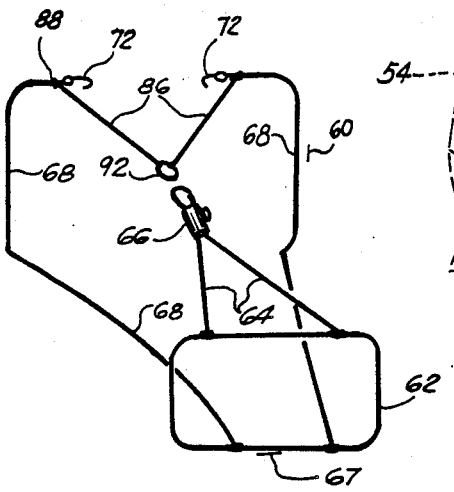
FIGS. 2*a* and 2*b* depict two described embodiments of the invention in isolated form for clarity.

This invention relates to the securing of toilet lids in a closed position to prevent access by toddlers and infants to the interior of a toilet bowl. Such devices must be child proof against the curious manipulations of a toddler but must be easily removed and refastened when it is desired to use the toilet.

As depicted in the drawings, the invention as disclosed herein is shown upon a standard floor mounted toilet 10.

Toilet 10 is fixedly mounted to a floor 24 through a base pedestal 20. This affixation is a sealed affixation incorporating a hidden internal seal (not shown) and is not readily removed without skill or assistance. Particularly, no method of locking the toilet lid which requires that the toilet be removed and reinstalled is deemed feasible.

The major components of a toilet, as are well known, include a bowl 32 which is open, contains water and is the attractive nuisance to be secured; pivoted to the bowl 32 is a seat 36 fastened through a seat hinge 40 along a rear section of the toilet bowl 32. Also pivoted on a lid hinge, usually journaled to the seat hinge 40 is a lid 44.

Standard flush toilets 10 also contain a water closet or water tank 52 which contains a supply of flushing water. The entire unit is plumbed into supporting piping through an adjacent wall; this piping is not shown here but represents a second, permanent affixation of a toilet 10 to its surrounding structure which is not readily removed for the installation of accessories.

Figure 2B:
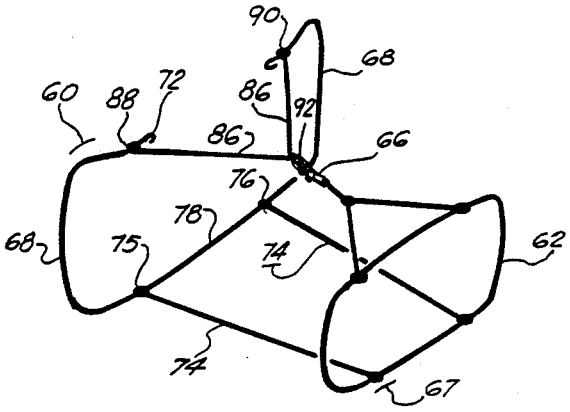

The securing device 60, two forms of which are shown in FIGS. 2*a* and 2*b*, is described below. The device as described corresponds to a model found most effectatious for installation upon a toilet 10 of the type having a floor mounted pedestal. It will be obvious to those skilled in the art reviewing the application how the device is readily modified and adapted to the less commonly encountered wall mounted toilets 10 which have no base pedestal but which are rather affixed through a rear section 54 into a supporting wall.

The entire securing device 60 is composed of a wide flexible strap, preferably a cloth such as a nylon strap. All joints and knots are, as is known in the art, double stitched back upon themselves for strength so that they can resist the tugging and pulling of an inquisitive toddler or small child. The art of so sewing straps for suitable strength is well understood and is not further discussed here.

The securing device 60 is composed of a forward girth strap assembly 62, an essentially oval strap section of a size to encompass a front portion perimeter 12 of the toilet but sufficiently small in diameter that it does not slide towards the rear 14 of the toilet.

Affixed to the upper perimeter of the forward girth strap assembly 62 from two spaced apart attachment points 63 is the a fore bridle assembly 64. Fore bridle assembly 64 is a continuous length of strap extending from one fixed vital attachment point 63 to a second spaced apart bridle attachment point 63, both such bridle attachment points 63 being so located that when the forward girth strap is installed encompassing the front portion 12 of the toilet, bridle assembly 64 substantially covers the forward top portion of the lid 44.

Figure 1:
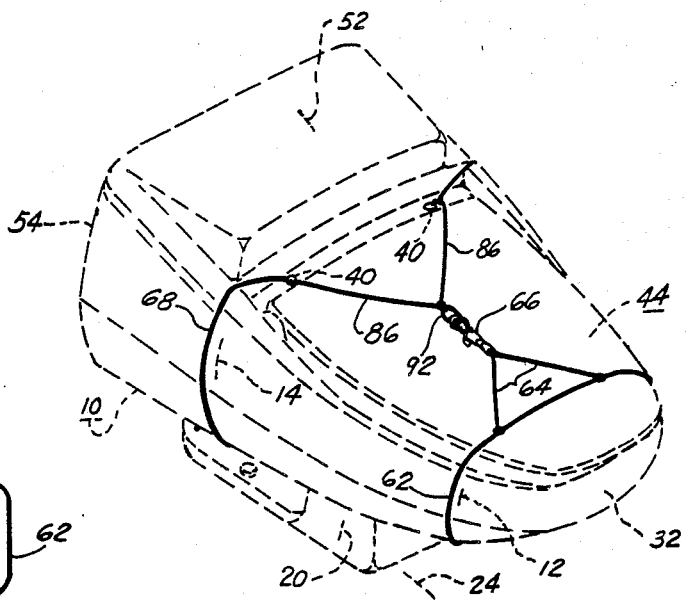
FIG. 1 is an illustrative view of a prototypical toilet with the invention in place.

While the fore girth strap in the FIG. 1 is shown as encompassing and enclosing the lid 44, an alternative form of the forward girth strap assembly covers only the front portion of the bowl 32, with the full bridle assembly 64 extending up over the front of the seat 36 and lid 44. Either construction is considered acceptable, but the latter is occasionally found of greater utility on older toilet bowls having a greater depth and a lesser fore and aft dimension.

At the center of fore bridle assembly 64 is found a quick release snap means 66 for removable interconnection with an after release snap means 92 further described below.

In one embodiment, least one second side strap 74 extends, fixed from a point adjacent a bottom edge or section 67 for a distance interconnecting with and forming part of a after girth strap 68.

After girth strap 68 is a large encompassing strap extending laterally around a rear portion 14 of the toilet 10.

In preferred form, after girth strap 68 is an independent continuous strap affixed at a point of affixation to side strap 74 and terminating in two hook assemblies 72. The length of after girth strap 68 is such that when the hook assemblies 72 are fastened to seat hinges 40, girth strap 68 is substantially tensioned enclosing rear portion 14 of the toilet bowl.

In this configuration, after girth strap 68 is a continuous strap from first hook assembly 72 to the opposing hook assembly 72 or second hook assembly 84. It is interconnected to first girth strap 62 by first side strap 70 and, optionally by a second side strap 74. If second side strap 74 is provided for purposes of convenience or balance, second side strap 74 is fixed by sewing and the like to fore girth strap 62 but encompasses and retains after girth strap 68 by means of slide loop affixation 76 as detailed in FIG. 5.

Figure 5:
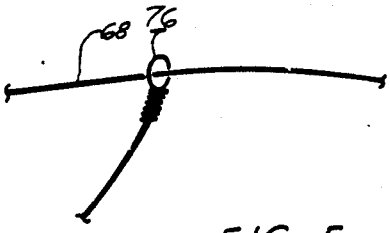
FIG. 5 is a detail of sliding loop for affixation of straps in the invention.

An after bridle assembly 86 extends from an end of after girth strap 68 adjacent first hook assembly 72 to which it is affixed extending over to and enclosing after girth strap 68 at a point adjacent second hook assembly 84 utilizing a slide loop affixation 76 as shown in FIG. 5. This is necessary so that the securing device 60 may be readily installed upon a base pedestal toilet, by fastening the free end 84 of the after girth strap around the rear portion 14 of the toilet behind the base pedestal 20, passing it as necessary through the slide loop affixation to second side strap 74 if one is provided and then through a bridle slide loop affixation 90 adjacent second hook assembly 84.

Figure 3:
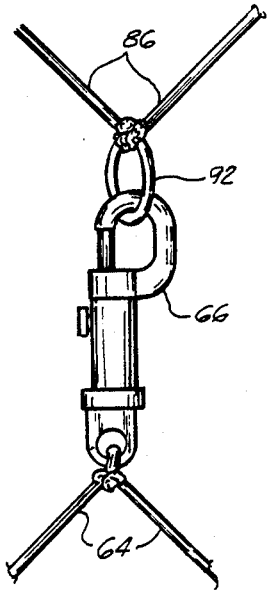
FIG. 3 is a detailed depiction of one form of quick release fastener of the invention.
Figure 4:
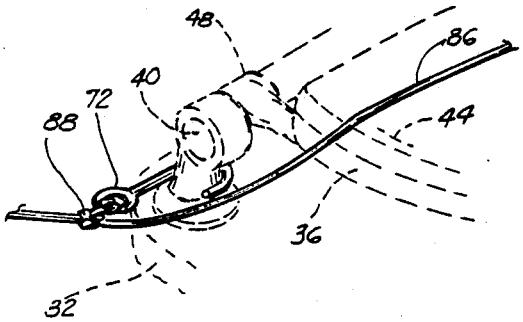
FIG. 4 is a detailed view of one form of securing hook for the aft girth strap of the invention.

After bridle assembly 86 as with fore bridle assembly 64 emanates from two spaced apart base points and has, affixed at a center point a cooperating releasable snap means 92, cooperating with release snap means 66. In a preferred embodiment of the invention, this takes the form, as shown in FIG. 3, of a snap hook and ring of any of the types known to be readily installable and readily removable. Any safety catch which is known to be relatively resistant to tampering by toddlers but easily manipulated by adults may be provided, whether a spring clip or as a snap ring and hook as shown in the illustration.

An alternate form of the invention, of particular utility for affixation to toilets of the wall mounted type having no base pedestal, or alternatively, for toilets of a relatively older style having a relatively deep bowl where the fore and aft dimension is not significantly greater than the vertical dimension, is obtained by omitting a rear lower cross girth strap section 78 shown in FIG. 2 so that the after girth strap 68 is composed of two strap sections, parallel to each other, one extending from hook 72 to point of affixation 75 and thence continually to and affixed to fore girth strap 62 in much the same manner as the first side strap 74 would be. The second portion of this alternate after girth strap 68 extends from a point of affixation to fore girth strap 62, much in the same manner as second side strap 74 but extending continually from point 76 circumferentially around toilet bowl to second hook assembly 84. This second form eliminates the need for sliding loop construction 76, and the aft bridle assembly 86 fixedly fastened at both ends of the aft bridle assembly.

Alternative, acceptable configurations include one in which after girth strap 68 in lieu of terminating the two hook assembly 72 in inner connection with hinge points upon a toilet bowl, the hook assembly 72 would be snap assemblies fastening to each other to produce a continuous after girth snap snugly fit around the rear of toilet 10 in a position to the rear of the lid and seat hinging points. Alternatively, in the embodiment to the invention shown in FIG. 2*a*, after girth strap 68 could be a continuous somewhat elastic strap again adjusted so as to fit snugly around a portion of the toilet 10 to the rear of the lid hinge point, the elastic insuring a snug fit. Further, for those circumstances in which a wall mounted toilet of the type having no base pedestal exist, it may be preferable to bring all the fastening points of the after girth strap and the fore girth strap together to a single point of attachment or, where a side strap 74 is utilized, a single such strap, essentially centered would be of use.

It can thus be seen that the invention in its general form comprises a fore girth strap sized to slip over and enfold a front section of a toilet bowl, a rear girth strap encircling a rear section of a toilet bowl, the both being fastened one to the other at their bottom edges either directly or through intervening side straps. The toilet lid is secured by two mating bridle assemblies, each of which is affixed at spaced apart points to each of its respective girth straps which join together at a single point through a readily release fastening.

Several variations on aft girth strap 68 have been disclosed, each being preferable depending upon the exact construction of the toilet.

The invention, therefore, is not limited to the exact constructions shown but extends to those wider equivalents as are claimed.

I claim:

1. An apparatus for removably securing the lid of a toilet against the bowl thereof comprising:

a first girth strap circumferentially surrounding a forward portion of a toilet;

a second girth strap circumferentially surrounding a rearward portion of said toilet;

means for adjoining said first and said second girth straps proximate a lower portion thereof;

a first bridle strap extending from spaced apart points upon an upper portion of said first girth strap;

a second bridle strap extending from spaced apart points upon said second girth strap;

means for removably affixing said first bridle strap to said second bridle.

2. The apparatus as described in claim 1 above, wherein said means for connecting said first and said second girth strap comprise at least one side strap fixedly attached to the lower end of said first girth strap extending to a point of attachment to said second girth strap.

3. The apparatus of claim 1 above, wherein said second girth strap comprises:

a first and a second rear girth strap member;

each of said first and said second rear girth strap members extending from a point of affixation at a lower point of said first girth strap, said rear girth strap circumferentially surrounding to a rear portion of said toilet.

4. The apparatus as described in claim 3 above, wherein said affixation to said toilet further comprises:

means at an end of each said rear girth strap member, distal from said first girth strap for attachment to a provided edge point on said toilet.

5. The apparatus as described in claim 3 above, wherein said rear girth strap further comprises:

the ends of each said rear girth strap member being interconnected;

said rear girth strap member being positioned to a rear portion of said toilet with respect to a point of fixation of a toilet lid thereto.

6. The apparatus as described in claim 1 above, wherein said second girth strap further comprises:

an open ended strap having two ends thereof, circumferentially engaging a rear section of said toilet;

means for affixation on each end thereof for removably affixing the ends thereof to a provided hinge point on said toilet.

7. The apparatus of claim 6 above further comprising: said second bridle strap means fixedly attached at one end of said second girth strap, proximate said means for affixation;

said second bridle strap being removably affixed to the other end of said second girth strap proximate said means for affixation.

8. The apparatus of claim 6 above, further comprising:

said means for affixation being interconnected, affixing each end thereof;

said second girth strap being positioned to a rear portion of said toilet to the rear of a point of affixation of a lid thereof.

* * * * *